United States Patent [19]

Gentry et al.

[11] Patent Number: 4,673,934

[45] Date of Patent: Jun. 16, 1987

[54] INFLATABLE RADAR REFLECTOR

[75] Inventors: Gene E. Gentry, Alvin; John H. Bain, Jr., Dickinson, both of Tex.

[73] Assignee: Gabb Corporation, Houston, Tex.

[21] Appl. No.: 670,211

[22] Filed: Nov. 13, 1984

[51] Int. Cl.[4] ..... H01Q 1/34

[52] U.S. Cl. ..... 342/8; 343/709; 343/915

[58] Field of Search ..... 343/915, 872, 916, 880, 343/709, 881, 18 C; 342/8-10

[56] References Cited

U.S. PATENT DOCUMENTS

| | | | |
|---|---|---|---|
| 2,534,716 | 12/1950 | Hudspeth et al. | 343/18 C |
| 2,576,255 | 11/1951 | Hudspeth et al. | 343/18 C |
| 2,912,687 | 11/1959 | Leonard | 343/915 |
| 3,041,604 | 6/1962 | Collis et al. | 343/18 C |
| 3,047,860 | 7/1962 | Swallow et al. | 343/18 C |
| 4,063,241 | 12/1977 | Jouanno | 343/18 C |

*Primary Examiner*—Eli Lieberman
*Assistant Examiner*—Michael C. Wimer
*Attorney, Agent, or Firm*—Bill B. Berryhill

[57] ABSTRACT

Improved radar reflector apparatus of the type comprising a collapsible and inflatable envelope surrounding a collapsible reflector array made of reflectors which, when the envelope is inflated, form a plurality of corner reflectors. The improvement resides primarily in the fact that each of the reflectors is mounted or suspended in the envelope by a string mounting network independently of the others.

9 Claims, 6 Drawing Figures

INFLATABLE RADAR REFLECTOR

BACKGROUND OF THE INVENTION

1. Field of the Invention

The present invention is directed to an improved inflatable radar reflector. More particularly, it is directed to an improved means of internally suspending a system of corner reflectors that are inherently deployed to an accurate alignment upon inflation of the inflatable radar reflector.

2. Description of the Prior Art

The facility with which lost objects and/or persons may be located and retrieved or rescued is related to the effectiveness with which a radar source signal may be reflected near the object and/or person. When the object intended to reflect the radar signal is relatively small and distant, significant difficulty may be encountered in locating either the object or, for example, lost personnel such as campers, hunters, military personnel, stranded boatmen or the like. The successful incorporation of an effective corner reflector array into an inflatable device provides a radar cross-section which is many times larger than an object the same size without the corner reflector array. This enhanced radar cross-section may be seen from long distances.

The reflector may be included in an inflatable assembly having flexible or collapsible internal corner reflectors that may be folded into an extremely small volume, such as into the pocket of a life vest, so as to be easily stored. The corner reflector array may reside in a flexible material which is resilient and not easily damaged, and which in any event may be easily repaired. The corner reflector array residing inside an inflatable envelope insures that the reflector may not be bent out of shape or otherwise functionally impaired, even during severe use. The inflatable reflector may be inflated orally or with compressed air or with lighter than air gas.

Previous U.S. patents have addressed the design of inflatable corner reflector systems. It has been suggested in U.S. Pat. No. 2,463,517 that a flexible reflector array may be constructed as a single unit having the intersecting faces of the corner reflectors sewn together or otherwise joined together. The single unit reflector would then be suspended by six rubberbands from the points of the flexible reflector array to the internal surface of an inflatable envelope. It is apparent that the forces exerted by the rubberbands upon the individual sides of the reflector array are not evenly distributed to the areas of each of the reflective surfaces. Small variations in the size, shape, and alignment of each of the reflective surfaces result in puckers, sags, twists, and angular error of the reflective surfaces upon inflation of the system. The imperfections result in a loss of radar cross-section enhancement when the error exceeds one-quarter of the wavelength of the radar signal frequency. The application intended for this referenced patent was for relatively large weather balloons for use at a time when radar systems operated in longer wavelengths, i.e. lower frequencies than many modern radar systems. The imperfections associated with this configuration were not as critical for relatively large balloons and longer wavelengths as they are for small objects and current radar systems with shorter wavelengths.

U.S. Pat. No. 3,103,662 suggests improving the construction of an inflatable radar reflector by attaching the edges of the reflector array into the seams of the outer inflatable envelope. The corner reflector array is also constructed as a single unit with the intersecting surfaces sewn together or otherwise formed. The outer edges of the array are then sandwiched into the outer surface seams to form an octahedron shaped inflatable structure. Instead of reducing the puckers and errors in the reflector as claimed, this configuration, in practice, results in very pronounced and obvious distortion of the corner reflector surfaces when inflated. The strain in the outer inflatable surface material is greater at the center of each triangular area than it is in the vicinity of the points. This results in a distortion in the shape when inflated. As the octahedron shape is inflated the center area bulges out and the points of the octahedron area drawn closer to each other. The result on the attached corner reflector arrays is to hold tension on the middle of the seam edge while placing the areas attached to the points of the octahedron in compression. This results in very pronounced twists and puckers in the reflector surfaces. The magnitude of the resulting distortion is a function of the gas pressure and is greater as the pressure is increased.

Thus, even though the basic idea of providing an inflatable radar reflector is basically sound, the prior art devices for doing so are not. The distortions caused by the construction of radar reflectors of the prior art are so great as to render them ineffective for modern-day radar systems utilizing shorter wavelengths.

SUMMARY OF THE INVENTION

The present invention is directed to an improved means for the internal erection of a flexible or collapsible corner reflector array within an inflatable envelope. The advantages which result from the successful incorporation of an effective corner reflector array, made from flexible materials, into an inflatable system are many.

The present invention attains a very accurate corner reflector configuration by employing a reflector configuration which is comprised of a number of independent reflector members. Different configurations are possible utilizing from seven to twelve or more independent reflectors. Each reflector member is suspended independently within the inflatable envelope by a string or tension means which circumnavigates the reflector array through folded seams along the edges of the reflector members. A string or tension means passes alternately through an edge seam of the reflectors and then through an attaching clip means, through another edge seam, through another attaching clip means, etc. until all of the reflectors are circumnavigated. The attaching clip means may be fastened to eyelets or otherwise attached on the inner surface of the inflatable envelope. Upon inflation, the reflectors are held taut and flat and in the proper orthogonal orientation.

The principal feature and advantage of the present invention is that the reflective surfaces of the corner reflector array are held flat and taut and with a significant reduction in puckers, sags, twists, or angular misalignments as results if each of the reflective surfaces is surrounded by a tension producing seam or connection.

Another feature and advantage of the present invention is the provision of a significantly greater radar cross-section enhancement than with a reflector of the same size and configuration with the puckers, sags, twists, and angular misalignments inherent in prior art designs.

Another feature and advantage of the present invention is the provision of greater radar cross-section enhancement for radar systems operating at higher frequencies, i.e. shorter wavelengths, than with similar reflectors whose puckers, sags, and angular errors exceed one quarter of the wavelength of the radar signal.

Still another feature and advantage of the present invention is the fact that the reflector can be made with greater accuracy and precision than previously constructed inflatable corner reflectors since the accuracy of alignment is not a function of the accuracy of the shape of the individual reflective surfaces.

Still another feature and advantage of the present invention is the fact that the corner reflector array thereof may be more easily constructed of uniform components which will be aligned properly without the need for precise attachment one to the other.

Still another feature and advantage of the present invention is the allowance of a wide range of internal gas pressures without a resultant loss of accuracy. The accuracy of alignment of the reflective surfaces is attained when the reflector is taut and is maintained, if not enhanced, as the pressure is increased.

Still another feature and advantage of the present invention is the fact that the corner reflector array may be assembled and externally adjusted to its inflatable envelope and then placed in the inflatable envelope as a step in manufacture.

Still another feature and advantage of the present invention resides in the fact that since the reflector array is constructed and adjusted prior to incorporation into the inflatable envelope, quality assurance testing may be performed prior to final sealing of the inflatable envelope.

Many other objects and advantages of the invention will be apparent from reading the description which follows in conjunction with the accompanying drawings.

DESCRIPTION OF PREFERRED EMBODIMENTS

Figure 1:
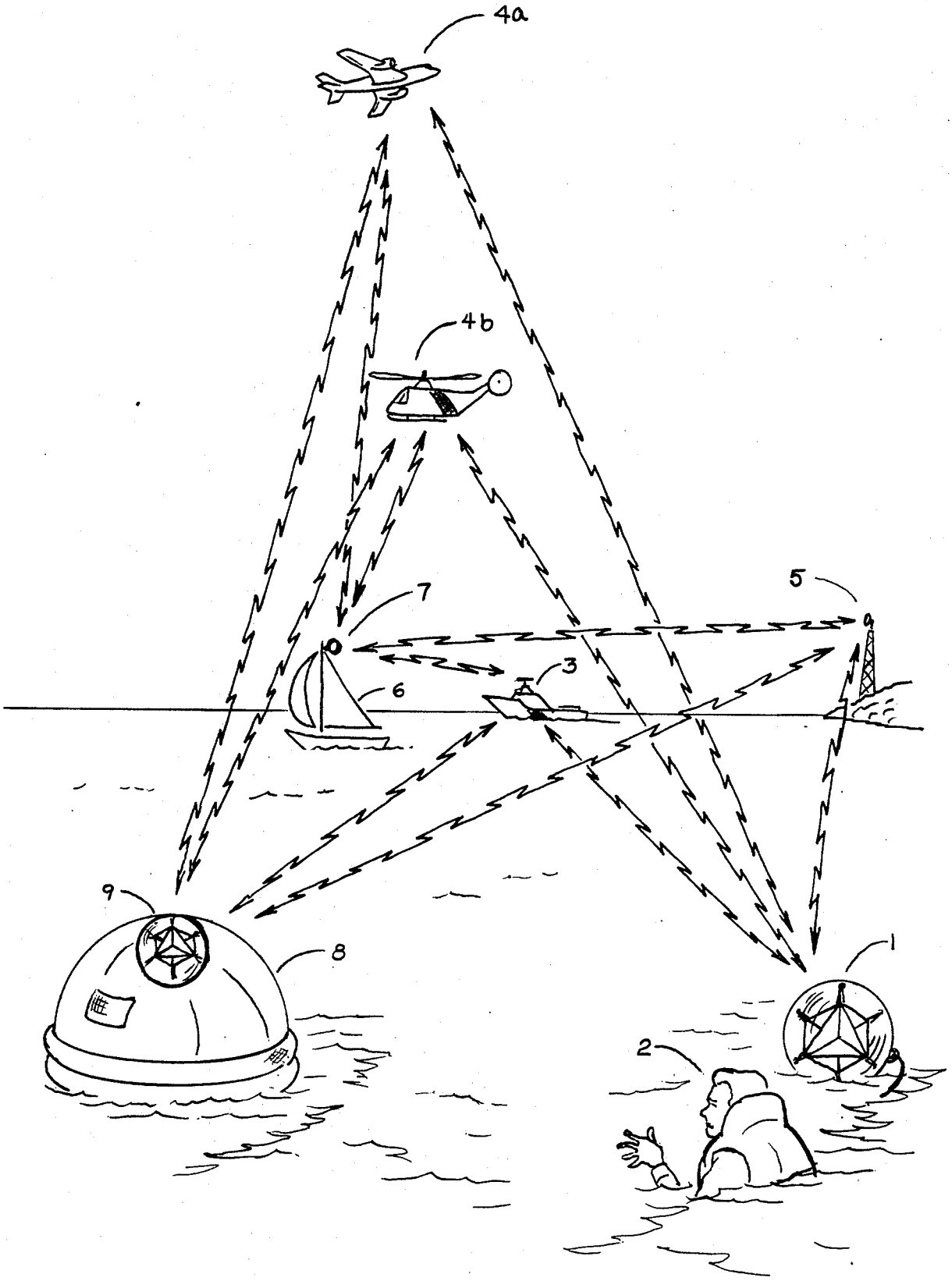
FIG. 1 is a pictorial view illustrating application of inflatable radar reflector apparatus according to a preferred embodiment of the invention.

There is shown in FIG. 1 an illustrative example of how the inflatable radar reflector of the present invention may operate. For example, a buoyant inflatable reflector 1 may be deployed by a person 2 in the water so as to facilitate discovery and rescue. A reflected signal may be received by a water-borne vessel 3 or by an airplane 4*a* or helicopter 4*b*, or by land-based radar 5. Likewise, a boat 6 may be located by a reflected signal when a reflector 7 is used as a signal reflector, such as, for example, back to vessel 3 or aircraft 4*a* or 4*b*, or back to land-based radar 5. Further, a survivor capsule 8 having a reflector 9 deployed therein may be discovered by vessel 3 or aircraft 4*a* or 4*b* or land-based radar 5. Thus, it is readily recognized that whether the object be a man or a boat or a survivor capsule, the discovery and rescue thereof is markedly enhanced by the reflectors 1, 7 or 9 of the invention, no matter whether the lost object or person is in the water or on land.

Figure 2:
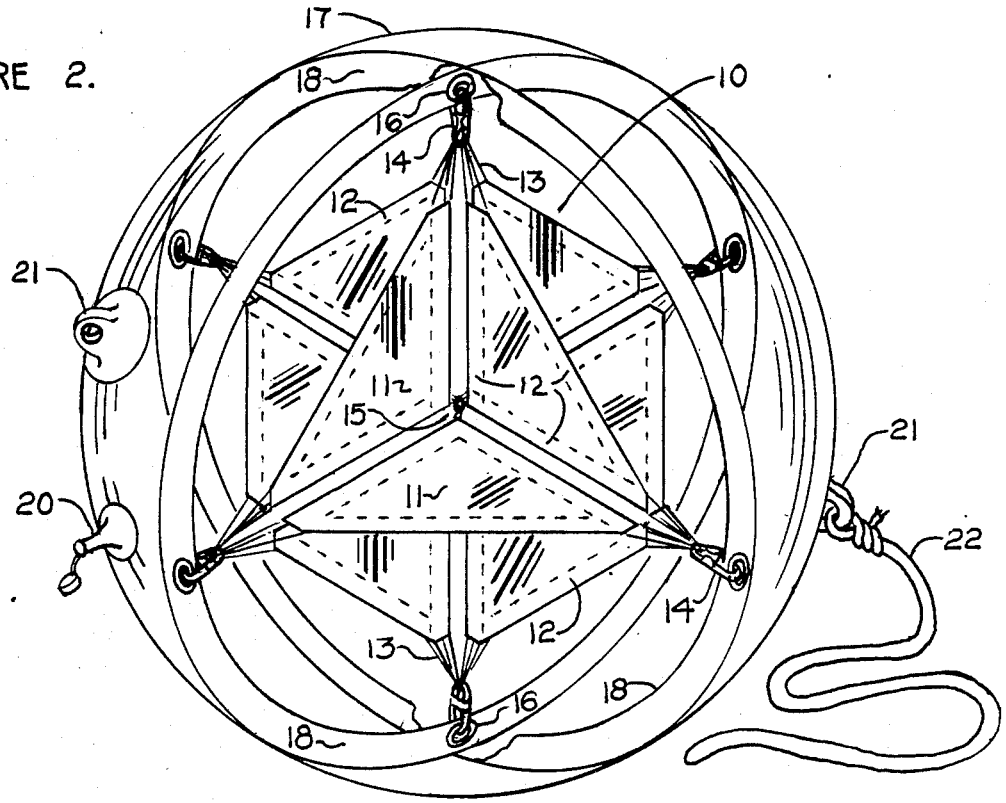
FIG. 2 is a side view of an inflatable radar reflector according to a preferred embodiment of the invention.

FIG. 2 of the drawings illustrates a preferred embodiment of the invention. A corner reflector array 10 is formed by twelve triangular reflectors 11 having reflective surfaces on each side thereof and which are made of flexible, radar wave reflective material such as metal impregnated cloth, aluminized mylar or other metalized film material, laminated foil, impregnated rubber, or the like. When in proper position, the triangular reflector members 11 form a plurality of three-sided corner reflectors of trihedral section, the apexes of which substantially coincide at the center 15 of said array 10. While corner reflectors of trihedral section are preferred, they can be dihedral. Thus, the term "corner reflector" is meant to include both. In the embodiment of FIG. 2, each of the triangular reflectors 11 defines an isosceles right triangle and the reflector array 10 comprises eight three-sided corner reflectors the sides of which are substantially at right angles to each other. The hypotenuses of the triangular reflectors define the edges of a regular octahedron.

The reflectors 11 are made with a folded longitudinal seam 12 along each edge. This edge seam 12 provides a path and enclosure through which a tension producing string 13 may pass. The string 13 consists of a line which is lightweight, small in diameter, strong, and has a low coefficient of friction, i.e. ordinary fishing line made of, e.g. braided Dacron or monofilament line, or a strong thread such as Nylon, Kevlar or the like. Elastic material may also be used. The string 13 also passes through attaching clips 14 which are located at each of the six outer apexes of the reflector array 10. A small ring located at the center 15 of the array 10 allows all of the paths of the string 13 to converge at the center of the array 10. The string 13, starting at an attaching clip 14, passes through a folded edge seam 12 from an apex to the center of the array 10. Then it passes through the center ring at 15; then through the edge seam 12 of another reflector from the center to another outer apex of the array 10; then through another attaching clip 14; then through an edge seam 12 of the hypotenuse edge of a reflector 11 to another apex; then through an attaching clip means 14; then through an edge seam 12 from the apex to the center; and so on until all of the reflectors 11 are thus suspended. Each reflector 11 thus suspended has a segment of the string 13 through each of its three folded edge seams 12. The string 13 passes through the ring at the center 15 and the attaching clips 14 multiple times. It is possible to suspend all of the reflectors using one continuous length of string 13. However, the preferred method of suspension uses three separate strings, one for each of the three orthogonal planes.

The attaching clips 14 are attached to eyelets 16 located near the inner surface of an inflatable envelope 17. The inflatable envelope 17 may be constructed of flexible, water- and air-impermeable but radar wave permeable material such as polyvinylchloride film, polyurethane film, Mylar, Tedlar, or other plastic film material, rubber, sealed cloth material or the like. The preferred inflatable envelope is constructed as a sphere of four or more sections or gores having airtight seams adjoining the various sections to form the inflatable envelope 17. These seams are preferably left with untrimmed flaps 18 on the inner surface of the envelope 17 and oriented ninety degrees from each other. Eyelets 16 may be affixed to the untrimmed flap 18, thus providing orthogonal points of attachment for the attaching clips 14 at the apexes of the corner reflector array.

As the inflatable envelope 17 is inflated, the string 13 is drawn tight. The total length of the string 13 is several times longer than the corresponding diameter of the inflatable envelope 17. Therefore, a small expansion in the diameter of the inflatable envelope 17 results in a multiplied increase in the length of string required. For this reason, as the inflatable envelope 17 is inflated, the slack in the string is quickly taken up without the necessity for great accuracy in the adjustment of the length of the string 13. Since each reflector 11 is surrounded by the tight string 13, the reflective surfaces of the reflectors 11 are held taut and flat without puckers, sags, or twists. The string 13 is able to slip through the folded seams 12, the attaching clips 14, and ring at the center 15 so as to become aligned orthogonally. The accuracy of the angular alignment of the reflectors 11 is a function only of the accuracy of placement of the eyelets 16 in the inflatable envelope 17 and is not dependent upon the accuracy of construction of the reflectors 11.

An inflation valve 20 provides for the introduction of gas into the inflatable envelope 17. The type of inflation valve used will vary depending on whether inflation is to be accomplished orally, with compressed gas, or with a lighter than air gas. Grommets 21 may be attached to the exterior of the inflatable envelope 17 and provide attachment for a lanyard 22. The lanyard 22 may be provided for attaching the inflatable radar reflector system to a person or object.

Figure 3:
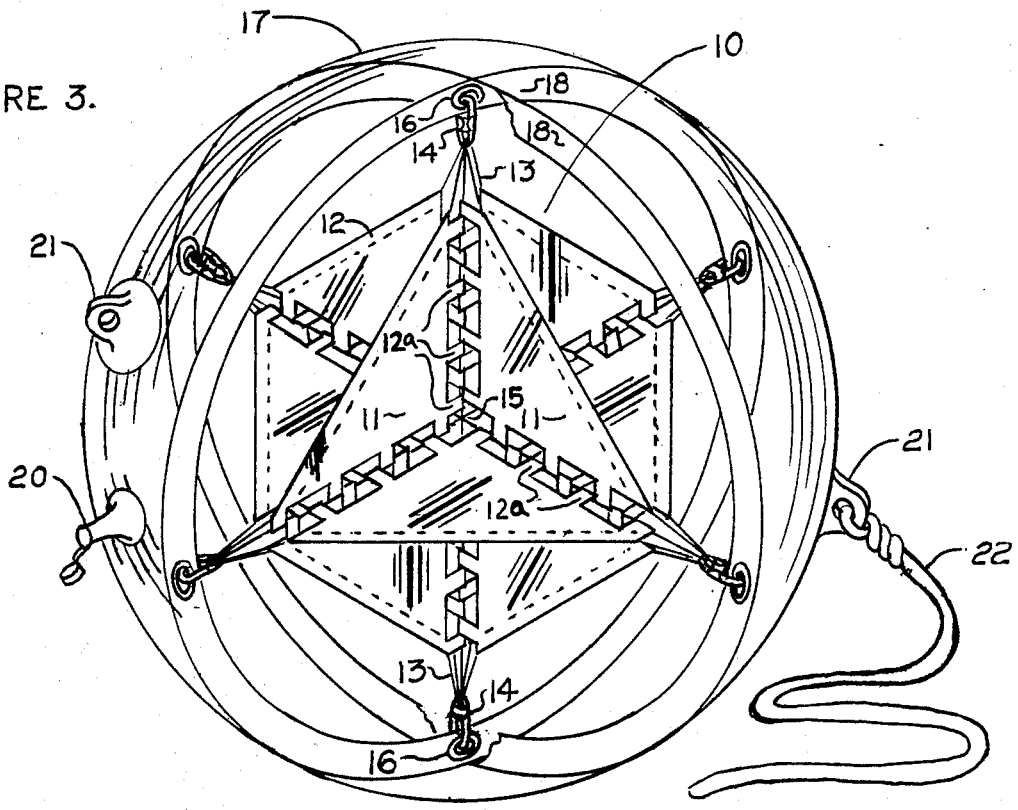
FIG. 3 is a side view of an inflatable radar reflector according to another preferred embodiment of the invention.

An alternate embodiment of the invention is illustrated in FIG. 3 wherein like numbers denote like parts. This alternate embodiment of the invention is identical in its construction and principle of operation with a specific difference relating to the edges of the reflectors 11. The edge seams 12 shown in FIG. 2 are cut out or modified as in FIG. 3 to form alternate voids and tabs 12*a* on each of the edges of which lie adjacent to each other. The tabs 12*a* are arranged so that they intermesh, fitting together along each common line. The intermeshing tabs 12*a* of the reflectors are thus able to share a common singular length of string 13. This sharing of a common length of string along the intersecting edges of adjacent reflectors 11 enables the total length of string to be shorter, with less friction, and eliminates the need for a center ring such as at 15 in FIG. 2.

Figure 4:
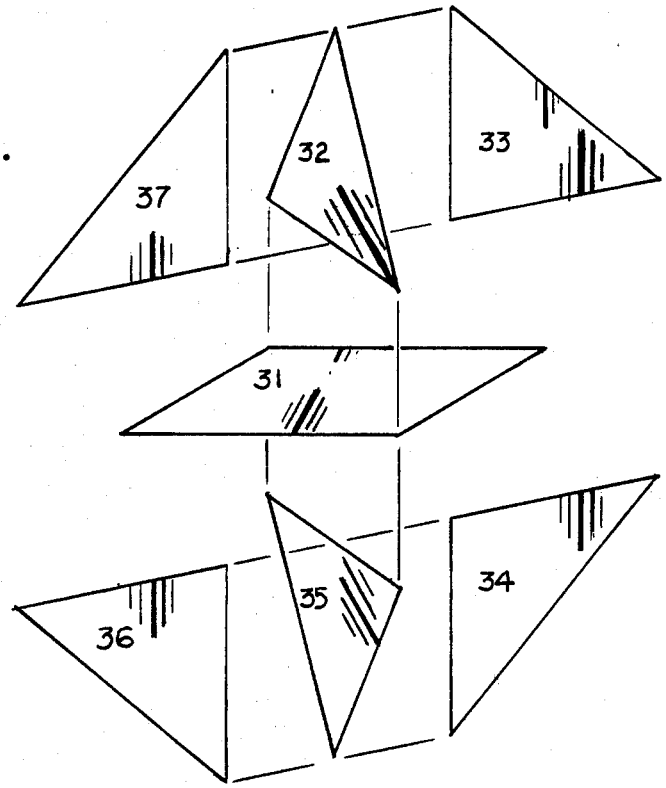
FIG. 4 is an exploded isometric view of reflectors for forming a reflector array for utilization in an inflatable radar reflector according to another embodiment of the invention.

Having described the invention in the preferred embodiments, it should be understood that inflatable radar reflectors having variations in the number and orientation of the reflectors are possible utilizing functionally the same component parts and employing the same principle of erecting a flexible array. For example, the array of the invention may be achieved with a minimum of seven reflectors 31–37 of three different shapes, as illustrated in FIG. 4, instead of the twelve identical triangular reflectors 11 of the preferred embodiments. In general, a similar reflector array may be composed from any number of reflective surfaces from seven to twelve.

Figure 5:
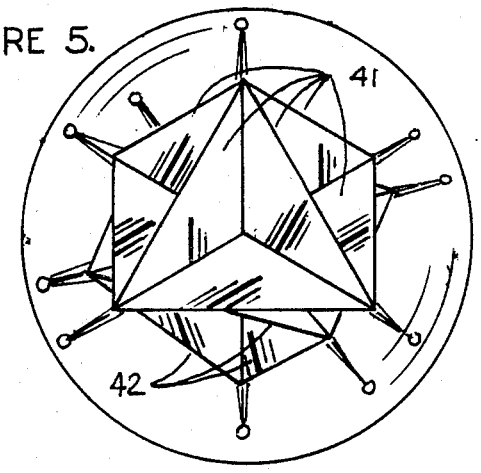
FIGS. 5 and 6 are isometric views of inflatable radar reflectors according to still other embodiments of the invention.

Another possible variation is an inflatable reflector in which the reflectors 41 in one hemisphere are rotated relative to the reflectors 42 of another hemisphere as is shown in FIG. 5. In this variation, ten points of attachment for ten eyelets and attaching clips may be required. Although this configuration is more complex, a slightly more omnidirectional reflector may be achieved.

Figure 6:
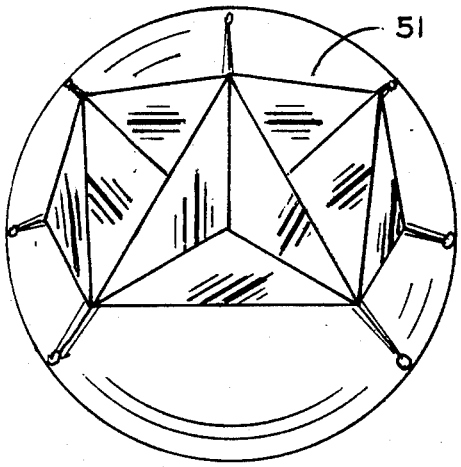

In the general case, any complex reflector array configuration 51 such as the one shown in FIG. 6 is achievable, if suspended as set forth herein. Although the preferred embodiment of the invention is described as utilizing a spherical inflatable envelope, it is possible in the general case to construct a variety of shapes for the outer inflatable envelope as long as the eyelets may be properly located within the inflatable shape. In fact, many variations of the invention are possible without departing from the spirit of the invention. Accordingly, it is intended that the scope of the invention be limited only by the claims which follow.

We claim:

1. Improved radar reflector apparatus comprising a collapsible and inflatable radar wave permeable envelope surrounding a radar reflector array having a number of radar wave reflectors which when said envelope is inflated are arranged to form a plurality of corner reflectors, said reflectors being of a flexible material so as to allow collapsing of said reflector array upon collapse of said envelope, the improvement comprising suspension means supporting each of said reflectors within said envelope independently of each other, of said reflectors so that upon inflation of said envelope each of said reflectors floats on said suspension means to seek out optimum planar disposition forming a plane substantially independent of and mutually orthoganal to the planes formed by each other of said reflectors.

2. Improved radar reflector apparatus as set forth in claim 1 in which the edges of each of said reflectors is provided with a longitudinal seam, said reflector array being suspended within said envelope by string means passing from the inner surface of said envelope through the seams of some of said reflectors to said center of said apparatus and back through other of the seams of said reflectors to said inner surface of said envelope.

3. Improved radar reflector apparatus as set forth in claim 2 in which the seams of adjacent edges of said reflectors are cut out to leave alternate voids and seam tabs, the seam tabs along the edge of a reflector being disposed in the voids along the edge of an adjacent reflector so that a single length of said string means passes through the seam tabs of said adjacent edges of said reflectors.

4. Improved radar reflector apparatus as set forth in claim 2 in which said string means comprises a continuous string passing back and forth from said inner surface of said envelope and center of said apparatus and through each of said seams.

5. Improved radar reflector apparatus as set forth in claim 2 including ring means at said center of said apparatus through which said string means passes from the seams of said some of said reflectors back through the seams of said other of said reflectors.

6. Improved radar reflector apparatus as set forth in claim 2 in which said string means is connectd to said inner surface of said envelope by connector means, said connector means allowing said string means to slip to positions of equal force.

7. Improved radar reflector apparatus as set forth in claim 6 in which said inflatable envelope is formed of multiple sections affixed. to one another by airtight seams having excess material which extends from said inner surface of said envelope and to which said connector means are affixed.

8. Improved radar reflector apparatus as set forth in claim 2 in which each of said reflectors in said reflector array defines an isosceles right triangle which when said envelope is inflated form eight trihedral corner reflectors of triangular section the sides of which are substantially at right angles to each other and the hypotenuses of said triangular reflectors of which define the edges of a regular octahedron.

9. Improved radar reflector apparatus as set forth in claim 2 in which said string means comprises two or more separate strings, one each for the reflectors of said reflector array which lie in a common plane upon said envelope inflation.

* * * * *